US005541570A

United States Patent [19]

McDowell

[11] Patent Number: 5,541,570

[45] Date of Patent: Jul. 30, 1996

[54] FORCE SENSING INK, METHOD OF MAKING SAME AND IMPROVED FORCE SENSOR

[75] Inventor: Donald J. McDowell, Riverside, Ill.

[73] Assignee: Force Imaging Technologies, Inc., Chicago, Ill.

[21] Appl. No.: 353,051

[22] Filed: Dec. 9, 1994

[51] Int. Cl.[6] ..... H01C 10/10

[52] U.S. Cl. ..... 338/47; 338/36; 252/513

[58] Field of Search ..... 338/36, 47, 99, 338/100, 111, 114; 252/513

[56] References Cited

U.S. PATENT DOCUMENTS

| | | | |
|---|---|---|---|
| 3,806,471 | 4/1974 | Mitchell | 252/518 |
| 3,859,478 | 1/1975 | Cragg et al. | 338/100 |
| 3,926,916 | 12/1975 | Mastrangelo | 252/63.5 |
| 4,120,828 | 8/1977 | Michalchik | 252/513 |
| 4,145,317 | 3/1979 | Sado et al. | 252/513 |
| 4,152,304 | 5/1979 | Tadewald | 338/114 |
| 4,315,238 | 2/1982 | Eventoff | 338/99 |
| 4,401,590 | 8/1983 | Yoshimura et al. | 252/513 |
| 4,489,302 | 12/1984 | Eventoff | 338/99 |
| 4,734,034 | 3/1988 | Maness et al. | 338/99 |
| 4,763,534 | 8/1988 | Hager | 338/114 |
| 4,856,993 | 8/1989 | Maness et al. | 433/68 |
| 5,033,291 | 7/1991 | Podoloff, et al. | 73/172 |
| 5,296,837 | 3/1994 | Yaniger | 338/47 |
| 5,302,936 | 4/1994 | Yaniger | 338/47 |
| 5,473,938 | 12/1995 | Handfield et al. | 73/146.5 |

FOREIGN PATENT DOCUMENTS

| | | | |
|---|---|---|---|
| 403050801 | 3/1991 | Japan | 338/99 |

*Primary Examiner*—Teresa J. Walberg
*Assistant Examiner*—Karl Easthom
*Attorney, Agent, or Firm*—Laff, Whitesel, Conte & Saret, Ltd.

[57] ABSTRACT

An improved carbon-free force sensitive ink for a force sensor. The ink when deposited and dried can function at temperatures of up to 350° F. and pressures of up to 10,000 psi. The preferred ink includes a thermoplastic polyimide binder, conductive particles, intrinsically semi-conductive particles, and dielectric particles, all of an average particle size of 1.0 micron or less. The preferred semi-conductive particles are molybdenum disulfide, ferric and ferrous oxide particles. The preferred conductive particles are conductive metal oxide compounds that deviate from stoichiometry based on an oxygen value of two, such as conductive tin oxide, $Fe_3O_4$ iron oxide, and mixtures of them. The preferred dielectric particles are silica. The binder is present in an amount of 20 to 80% by volume. The sensor and a method of making the sensor are also disclosed.

9 Claims, 2 Drawing Sheets

FIG. 1
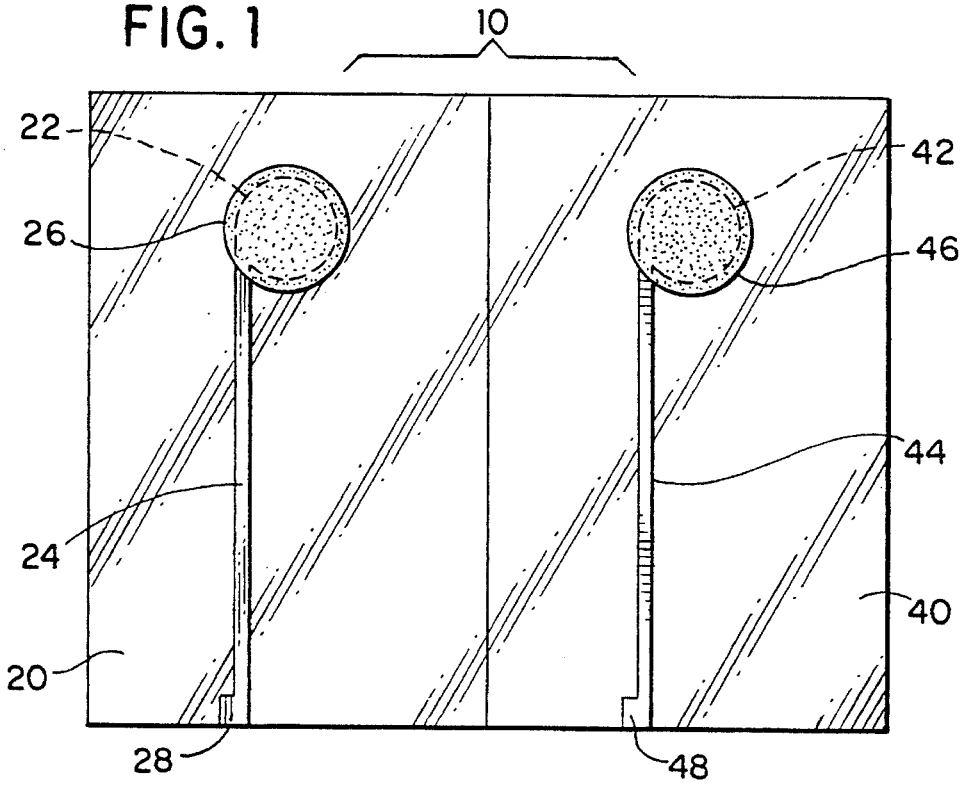
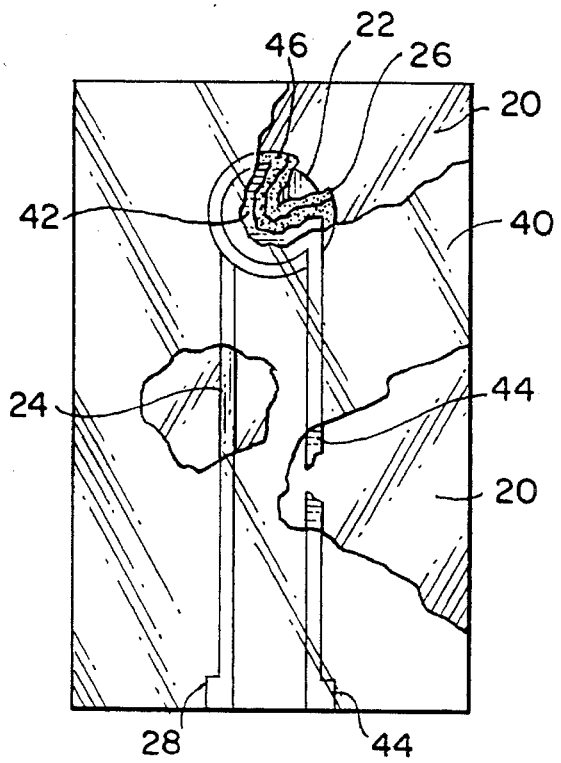
FIG. 2

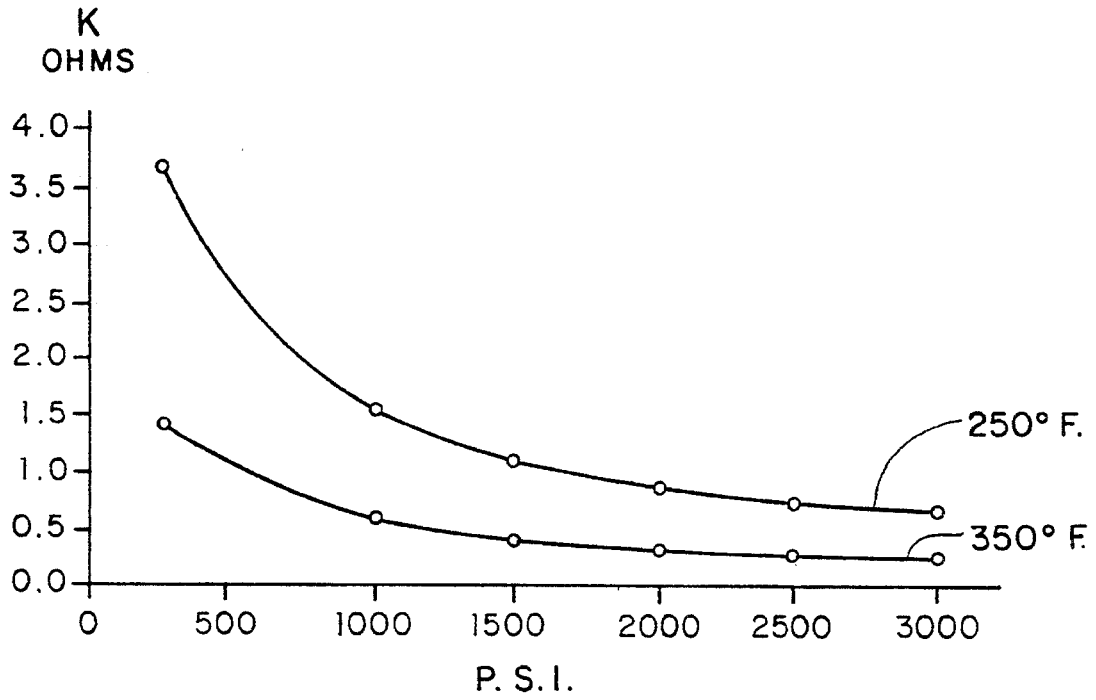
FIG. 3
FIG. 4
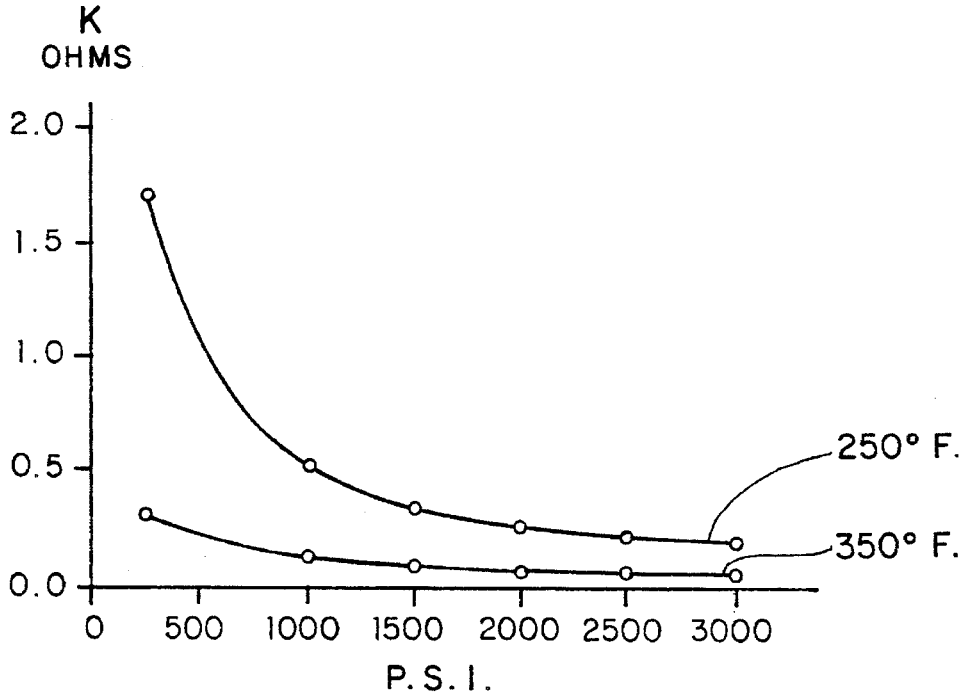

FORCE SENSING INK, METHOD OF MAKING SAME AND IMPROVED FORCE SENSOR

BACKGROUND OF THE INVENTION

For some time now a variety of techniques have been used to fabricate force sensors which provide an indication of the force applied between a pair of mating surfaces. These techniques have included the utilization of thin layers of semi-conductive materials disposed between the surfaces which respond to applied loads and which, when properly provided with conductors and associated circuitry, facilitate the display of indications of applied loads.

Early versions of products employing some of those features include those disclosed in U.S. Pat. Nos. 3,806,471 and 4,489,302. The common characteristic of those products is that they employ a body of semi-conductive material which, when stressed by the application of a load, will increase in conductivity. That increase in conductivity, which tends to increase as a function of the applied load, may then be used to provide a measurable output which varies, within limits, as a function of the applied load. Force sensing systems employing semi-conductive materials and based upon these principles are additionally shown by U.S. Pat. No. 4,856,993.

Typically semi-conductive layers used in force sensors must have certain characteristics to be sufficiently electrically conductive to be effective. Thus such layers must have electrically conductive areas which are close enough together to allow conduction under load. Under load the conductive areas must contact each other or the distances between them must be so small that electrons can flow from one conductive area to the next. The concentration of conductive areas must be large enough to provide a conductive path through the layer. The conductivity through the layer must be sufficient, under load, to provide a reliable and consistent range of different resistances (or conductances) to be able to distinguish among a range of applied loads. Typically the application of a load increases the capacity of the layer to allow electron transfer. Further, the conductivity changes should be reversible to the extent that the layer and surfaces on which the layer is applied permit restoration of the characteristics of the layer which are altered as load is applied. The pressure-sensitive, load responsive characteristics may be at the surface of the layer or internally thereof, or both.

A variety of intrinsically semi-conductive materials have been used to provide force sensors of this type. Such materials include particulate molybdenum disulfide, and ferrous and ferric oxide, among others. Such materials are disclosed in the patents referred to above, as well as in U.S. Pat. No. 5,296,837.

In addition to the use of semi-conductive systems to produce force sensing transducers, particulate conductive materials have also been used to produce force sensing transducers, as exemplified by the disclosure of U.S. Pat. No. 5,302,936. This patent and U.S. Pat. No. 5,296,837 both disclose the use of carbon as a conductive material in force sensing inks. The latter patent uses stannous oxide as a semi-conductive material in combination with carbon.

In more recent times, as shown by the prior art referred to above, semi-conductive, pressure-sensitive transducers have been made by depositing semi-conductive material, as in the form of an "ink" deposited by spraying or by a silk screening process, to form a thin layer or layers between a pair of electrodes. Typically, the electrodes are disposed on thin, flexible plastic sheets and have leads to a remote region in which the flow of an applied current may be sensed and measured. In such sensors, the electrodes and dried ink residue form a sandwich which acts as a force transducer, and which will provide a variable resistance (or conductance) which is related in a predetermined manner, to applied loads.

The prior art also teaches the use of blends of semi-conductive particles and conductive particles to provide a variably conductive force transducer. In particular, the prior art teaches the use of molybdenum disulfide as a semi-conductor blended with graphite or finely divided conductive carbon (such as acetylene black). The conductivity of inks based on these materials may be varied by the concentrations or ratios of the conductive and semi-conductive particles, frequently by blending a highly conductive ink with a less conductive ink. Polyester is the binder frequently used to bind the particles in these inks to a substrate on which a dried layer of the deposited materials is disposed. The resistance of the dried layer varies with load; hence these inks are referred to as being pressure-sensitive or force-sensitive.

These prior art inks have a number of shortcomings. For example, conventional binders, such as polyester binders, limit the useful application temperatures to a range of from up to 120° to no more than about 150° F. Above that temperature range, binders in confronting semi-conductive layers tend to bond to each other. Further, conductive carbon black when used as a pigment in resistive inks is very difficult to disperse uniformly and tends to agglomerate after dispersion. In addition its surface reactivity and adsorption characteristics significantly depend on processing variables and heat history. Further, graphite platelet orientation in the dried ink film is difficult to reproduce from sensor to sensor. These factors add great variability to the conductivity of such inks, hence cause unacceptable and undesirable variations within a product and from product to product.

Because molybdenum disulfide becomes more conductive as temperature increases, the use of molybdenum disulfide and conductive carbon black to provide the conductive paths requires changing their ratios or concentrations to adjust the conductivity of the ink for anticipated temperature conditions to be encountered. Because of the sensitivity of molybdenum disulfide to changes in temperature, compensation for temperature is difficult when the concentration of molybdenum disulfide is used by itself to adjust conductivity.

It would be desirable to provide a force transducer having improved force sensitivity, reliability, and reproduceability, as well as the additional capacity to function effectively not only at current temperatures at which force sensors are used, but at elevated temperatures, such as at temperatures of from at least 120° F. to 150° F. up to about 350° F., while providing sufficient sensitivity and reproduceability to provide a reliable and consistent indication of applied load.

SUMMARY OF THE INVENTION

In accordance with the present invention improved high temperature, carbon-free force sensing inks, methods of making them and resulting force sensors are provided. A high-temperature, carbon-free force sensing ink in accordance with this invention is adapted to be deposited in a thin layer between a pair of conductors, each conductor being disposed on a support surface, the thin layer having a resistance which varies as a function of the force applied thereagainst, the thin layer being usable in force sensing applications at temperatures of from 150° to 350° F. and wherein the ink comprises a high temperature binder, intrinsically semi-conductive particles, and conductive particles, the conductive particles preferably comprising a conductive metal oxide compound that deviates from stoichiometry based on an oxygen value of two. Preferably the conductive oxide particles are conductive tin oxide particles, $Fe_3O_4$ iron oxide particles or mixtures thereof.

The force sensing ink may include dielectric particles, such as silica having a particle size of 10 microns or less. The semi-conductive particles are preferably molybdenum disulfide particles. The particles in the ink are desirably of a particle size of 10 microns or less (and most preferably no more than about 1 micron in average size) and the high temperature binder is a thermoplastic polyimide resin. In a preferred form, the conductive and semi-conductive particles are present in a combined concentration of from at least 20% by volume to 80% by volume of the dried ink when deposited in a thin layer, and the binder is present in a combined amount of from 20 to 80% by volume.

In another aspect of the invention, a method of controlling the temperature and pressure responsiveness of a carbon-free, pressure sensitive, force sensing ink layer is provided. It comprises the steps of providing a first mixture of intrinsically semi-conductive particles and conductive particles in a ratio of from 15 to 65 parts of semi-conductive particles to 55 parts to 5 parts of conductive particles by volume, the remainder being a temperature resistant binder, providing a second mixture of intrinsically semi-conductive particles and dielectric particles in a ratio of from 15 parts to 65 parts of semi-conductive particles to 55 parts to 5 of dielectric particles by volume, the remainder being a temperature resistant binder, mixing quantities of said first and second mixtures having the same amounts of semi-conductive particles by volume to produce a force sensing particulate in a ratio of from 4 to 96% of the first mixture with from 96 to 4% of the second mixture thereby to provide an ink for deposit and use in a force sensor.

Preferably the semi-conductive particles are molybdenum disulfide particles and the semi-conductive and conductive particles are of an average size of 1.0 micron or less. Desirably the binder is a thermoplastic polyimide binder and the conductive and semi-conductive particles are present in an amount of at least 20% by volume and less than 80% by volume of the dried ink when deposited in a thin layer. In a most preferred form, the binder in present in a combined amount of from 20 to 80% by volume and the conductive and semi-conductive particles are present in a combined amount of from 80 to 20% by volume.

The resulting pressure-sensitive force sensor of the present invention comprises a thin, flexible film, a first electrode on the film, a carbon-free, pressure sensitive, resistive material deposited on the electrode, the material comprising a high temperature resistant binder, intrinsically semi-conductive particles and conductive particles comprising in the most preferred form, a conductive tin oxide, $Fe_3O_4$ ferric oxide or mixtures thereof, the conductive and semi-conductive particles being present in an amount of from 20 to 80% by volume of the material, and a second electrode spaced from the first electrode by the pressure sensitive, resistive material so that the material may be squeezed between the electrodes to vary the flow of current therethrough as a function of the force applied.

Desirably the material further comprises dielectric particles, the semi-conductive particles are molybdenum disulfide particles, and the semi-conductive and conductive particles are of an average size of 1.0 micron or less. Preferably the binder is a thermoplastic polyimide binder. In a most preferred form, the binder in present in a combined amount of from 20 to 80% by volume and the conductive and semi-conductive particles are present in a combined amount of from 80 to 20% by volume when deposited in a thin layer.

Further objects, features and advantages of the present invention will become apparent from the following description and drawings.

BRIEF DESCRIPTION OF THE DRAWINGS

FIG. 1 is a plan view of a pair of sensor elements which are assemblable to provide a sensor in accordance with this invention;

FIG. 2 is a plan view of a sensor as assembled from the elements of FIG. 1;

FIG. 3 is a graph illustrating the load sensing characteristics of a force sensor made in accordance with the present invention; and FIG. 4 is a graph illustrating the load sensing characteristics of a further force sensor made in accordance with the present invention.

DETAILED DESCRIPTION

In accordance with the present invention, inks are prepared which, when deposited, produce intrinsically semi-conductive layers which are stable and usable at customary temperatures as well as at temperatures of from about 120° F. to 150° F. up to 350° F. and which reliably reproduce responses to forces of as much as 10,000 psi at 350° F., even after repeated loading or prolonged exposure to elevated temperatures and loads.

A high-temperature resistant force sensor employing inks of the present invention is illustrated in FIGS. 1 and 2. As there is shown, a button sensor 10 comprises a pair of thin, flexible films 20, 40 which may be transparent. Films 20, 40 may be separate or may be the same sheet which is adapted to be folded into a sandwich array to produce the sensor 10. Polyester or polyimide films are preferred. Such films may be ICI polyester film and DuPont Kapton polyimide film. ICI polyester film is available from ICI Americas Inc., Concord Pike, New Murphy Road, Wilmington, Del. 19897. Films 20, 40 are provided with electrodes 22, 42, respectively, which are electrically connected to conductors 24, 44, respectively, and contacts 28, 48. The electrodes, conductors and contacts may be deposited, as by silk-screening a conductive silver ink, in a known manner, or by sputter coating a layer of copper with an overcoat of nickel, such as to a total thickness of 2400 angstroms. The conductors are adapted to be connected in an electrical circuit in a manner known to the art so that current flow through the sensor 10 may determined in use. The electrodes may be of any desired shape. In this case they are shown as being round. Each has a diameter of 0.5 inch.

Each of the electrodes is overlaid with a layer 26, 46 of carbon-free, pressure-sensitive resistive material of a diameter of 9/16 inch which is the dried residue of an ink which was deposited thereon. Such an ink may be deposited via silk screening, spraying or other known application techniques. In a preferred form, that material comprises a high-temperature resistant binder, semi-conductive particles, such as molybdenum disulfide or ferric or ferrous oxide particles, and conductive particles comprising a conductive metal oxide compound that deviates from stoichiometry, such as the reaction product of stannic oxide and antimony oxide, $Fe_3O_4$ iron oxide, or mixtures thereof. A layer is preferably formed over each of the electrodes 22, 42 in a diameter slightly greater than the area of the electrode, so that when a sensor sandwich is formed from films 20, 40 there are two thin layers of pressure-sensitive resistive material in contact with each other, and which layers entirely overlay the electrodes, thereby to assure that the desired contact area is uniform from sensor to sensor.

In a preferred form, the thin film sensor 10 is from about 2.5 to about 3.5 mils thick in the sensing area. The films 20, 40 are each about 1 mil thick, the electrodes 22, 42 are each about 0.2 to 0.3 mil thick, and each dried resistive ink layer is about 0.3 to about 0.5 mil thick. Other thicknesses of the elements of the sensor 10 can be used depending upon the application and other factors relevant to a particular application, all as is well understood by those working in the art.

In one preferred form of the practice of the present invention a high-temperature, carbon-free force sensing ink adapted to be deposited in a thin layer between a pair of conductors was prepared as follows.

EXAMPLE I

First, a 20 percent solution of thermoplastic polyimide resin was prepared by dissolving the polyimide in acetophenone. The particular polyimide used was Matrimide 5218, available from Ciby-Geigy Corporation, Three Skyline Drive, Hawthorne, N.Y. 10532. Matrimide 5218 is a fully imidized soluble thermoplastic resin based on 5(6)-amino-1-(4' aminophenyl)-1,3,-trimethylindane. To 30 grams of this solution, 10.6 grams of molybdenum disulfide (technical fine grade) and 2.6 grams of the reaction product of stannic oxide and antimony oxide (sometimes referred to as a conductive tin oxide) were added. The reaction product used had an average particle size of 0.4 micron and is available from Magnesium Elektron, Inc., 500 Point Breeze Road, Flemington N.J. 08822 under the trade name CP40W. The reacting material are primarily tin oxide (as $SnO_2$), namely 90 to 99%, with a minor amount of antimony oxide (as $Sb_2O_3$), namely 1 to 10%. The semi-conductive molybdenum disulfide and the conductive tin oxide reaction product particles had an average particle size of 0.7 and 0.4 micron, respectively.

The polyimide solution and added particles were mixed in a high speed laboratory mixer for ten minutes. The resulting ink was then silk screened in a conventional manner onto each of two circular conductors (approximately one-half inch diameter) and dried for 15 minutes at 275° F., at which time the acetophenone was completely driven off. The two layers of pressure-sensitive resistive material were placed in confronting contact in a conventional manner and the sensor thus formed was positioned between a pair of mating surfaces and placed under load. The results of testing under load are shown in FIG. 3 which illustrates, for temperatures of 250° F. and 350° F., the resistances in Kohms at the loads indicated.

EXAMPLE II

As another example of the practice of the present invention, a 20% solution of Matrimide polyimide resin was prepared as described above. To 30 grams of this solution was added 10.6 grams of molybdenum disulfide and 2.6 grams of conductive iron oxide (as $Fe_3O_4$). After mixing, depositing and drying in the manner described in Example I, and juxtaposing the semi-conductive layers, the sensor thus formed was positioned between a pair of surfaces and placed under load. The results of the testing under load are shown in FIG. 4 which illustrates, for temperatures of 250° F. and 350° F., the resistance in Kohms at the loads indicated.

As may be seen from each of FIGS. 3 and 4 at both temperatures of 250° F. and 350° F., and at loads of from 200 to 3000 psi, the sensors produced will satisfactorily discriminate the loading to which such sensors are exposed.

EXAMPLE III

Other carbon-free formulations of force sensing inks were made in accordance with the present invention. Each was found to have superior pressure-sensitive sensing characteristics at elevated temperatures. These formulations resulted from mixing moieties of Mixtures A and B. The solvent used in each moiety was acetophenone which completely evaporates after the ink is deposited. Thus the formulations are based on the compositions of the dried layer.

Mixture A consisted of:

| | Amount | % By Weight | % By Volume |
|---|---|---|---|
| Molybdenum Disulfide (technical fine) | 85 grams | 53.08 | 27.71 |
| Conductive Tin Oxide | 25 grams | 15.64 | 5.71 |
| Matrimide 5218 | 50 grams | 31.28 | 66.58 |
| | | 100.00 | 100.00 |

A typical Mixture A would use 260 grams acetophenone as a solvent.

Mixture B consisted of:

| | Amount | % By Weight | % By Volume |
|---|---|---|---|
| Molybdenum disulfide (technical fine) | 60 grams | 45.12 | 19.56 |
| Minusil 5 | 25 grams | 17.29 | 13.86 |
| Matrimide 5218 | 50 grams | 37.59 | 66.58 |
| | | 100.00 | 100.00 |

A typical Mixture B would use 260 grams of acetophenone as a solvent. Minusil 5 is a crystalline silica ($SiO_2$) available from U.S. Silica, P.O. Box 187, Berksley Springs, W. Va. 25111.

Carbon-free formulations comprising mixtures of moieties of Mixture A and Mixture B were prepared as set forth in Table I. Each was found to have superior pressure-sensitive sensing characteristics.

TABLE I

| | Amounts By Volume* | | | | | |
|---|---|---|---|---|---|---|
| Mixture A | 20ml | 30ml | 40ml | 50ml | 55ml | 57.5ml |
| Mixture B | 40ml | 30ml | 20ml | 10ml | 5ml | 2.5ml |
| Total | 60ml | 60ml | 60ml | 60ml | 60ml | 60.0ml |

*All formulations in Table I have identical ratios of particulate material to Matrimide 5218 by volume.

It is also to be understood that as the ratio of Mixture A to Mixture B increases, the ink layer becomes more conductive because the layer contains more conductive and semi-conductive particulates.

The force sensing ink system of the present invention is capable of sensing forces of up to 10,000 psi or more at temperatures of up to 350° F. The basic formulation of high temperature binder, semi-conductive particles and conductive particles may be supplemented or modified by changes in ratios and, as indicated, by incorporation of a dielectric particulate material, such as silica, thereby to optimize the responsiveness and sensitivity of the sensor for a given range of anticipated loads at anticipated operational temperatures for a particular load sensing application. Although the dielectric particulate tends to reduce the conductivity of the ink somewhat, it tends also to improve uniformity and repeatability of the ink layer resistance.

Preferred compositions in accordance with the present invention usually fall within the following ratios of components by volume. The sum of all components will equal one.

| | % of Volume |
|---|---|
| High temperature binder | 20 to 80 |
| Semi-Conductive particles | 15 to 50 |
| Conductive particles | 5 to 50 |
| Dielectric particles | 4 to 50 |

In preferred compositions Mixture A contains a ratio of 15 to 65 parts of semi-conductive particles and 55 to 5 parts of conductive particles by volume and Mixture B contains a ratio of 15 to 65 parts of semi-conductive particles and 55 to 5 parts of dielectric particles by volume, the remainder being the high temperature resistant binder. The admixture of Mixtures A and B is usually in a ratio of from 4 to 96 parts to 96 to 4 parts of contained particulate by volume.

The total concentration of conductive and semi-conductive particles should equal at least 20% by volume of the dried ink layer. That is because for the dried ink films to be conductive, there must be sufficient semi-conductive or conductive (or both) particles and they must be close enough together to allow electrical conduction and to obtain a conducting pathway through the layer. For a given particle size or distribution, the number of particles per unit volume is directly related to the number of conducting pathways in the ink. The upper limit of the particulate is approximately 80% by volume, and will depend upon adhesion and flexibility requirements of the dried ink layer. The thickness of the dried ink layer will be dictated in part by the environment in which the sensor is to be used, and the required flexibility and adhesion parameters.

The median particle size of the conductive, semi-conductive and dielectric particles should be less than 10 microns, and preferably no more than 1.0 micron in average size. Where possible, as is apparent from the foregoing, the particle size of the constituents should average no more than 1.0 micron in size.

As is known, most conductive and semi-conductive materials become more conductive as temperature increases. Changes are not linear. Neither is the coefficient of resistance change a constant with temperature. Indeed, the curve of resistance versus temperature or pressure is parabolic. All of these make clear why as temperatures increase, pressure-sensitive force sensing layers tend to become less discriminating and less resistive.

By blending, mixing, and balancing in accordance with the present invention, greater sensitivity and reproduceability, especially at higher temperatures and pressures, can be obtained over both broad and narrow ranges as compared to those available with presently available systems and inks.

Tests were conducted to ascertain the reliability of inks prepared in accordance with the present invention. To that end a 16% solution of Matrimide 5218 in acetophenone was prepared and was mixed with 23.5 grams of technical fine grade molybdenum disulfide (0.7 micron), 4 grams of conductive tin oxide (0.4 micron) and 4 grams of ground silica (1.0 micron) in a laboratory mixer at high speed to produce inks. Button sensors as described above were prepared by silk-screen deposition of the inks using a 280 mesh screen.

Using the mixing protocols indicated, resistances in (Kohms) at 3000 psi (at 350° F.) were obtained, all as indicated in Table II.

TABLE II

| Mixing Protocol | Sensor 1 | Sensor 2 | Sensor3 |
|---|---|---|---|
| High Speed Mixing-15 Min. | 3.37 | 3.80 | 3.55 |
| High Speed Mixing-15 Min., then aged 24 hours and mixed by hand with a spatula | 4.05 | 3.78 | 3.90 |
| High Speed Mixing-15 Min., then aged 6 months and mixed by hand with a spatula | 3.78 | 3.65 | — |

Tests were then conducted with carbon black as a conductive pigment. The results of these tests showed that the inks of the present invention produced sensors which were superior in quality and reliability to those produced using conductive carbon black. The carbon black tests also confirm that carbon black is very difficult to mix into a liquid carrier and to separate and disperse into its ultimate particle size.

To that end 20% solutions employing Matrimide 5218 in acetophenone were mixed with 13.2 grams of technical fine grade semi-conductive molybdenum disulfide (0.7 micron maximum particle size) and 4.32 grams of conductive carbon black (Shawingen acetylene black which is available from Chevron Chemical Co., P.O. Box 3788, Houston Tex. 77253). Button sensors as described above were prepared by silk-screen deposition of the inks using a 280 mesh screen. The inks were dried for 15 minutes at 275° F.

Using the mixing protocols indicated, resistances (in Kohms) at 3000 psi (at 350° F.) were obtained, all as indicated in Table III.

TABLE III

| Mixing Protocol | Sensor 1 | Sensor 2 | Sensor 3 |
|---|---|---|---|
| High Speed Mixing-15 Min. | 0.41 | 4.2 | 20.9 |
| High Speed Mixing-30 Min. | 3.75 | 5.1 | 5.23 |
| High Speed Mixing-60 Min. | 3.92 | 4.15 | 3.75 |
| High Speed Mixing-60 Min., then aged one week and mixed with wide wooden stick | 1.09 | 4.08 | 12.0 |

The last test of well mixed material aged one week demonstrated that pigments had settled and agglomerated, which is typical of conductive carbon black based inks. This data, as well as the results of testing of well-mixed, promptly applied inks incorporating carbon black, shows that reliability and reproduceability of results of applied carbon black based inks are so variable and erratic that such inks are not acceptable for use in force sensors.

From the foregoing it will be apparent to those skilled in the art that modifications may be made without departing from the spirit and scope of the invention. As such it is intended that the invention is to be limited only as may be made necessary by the claims appended hereto.

What is claimed is:

1. A carbon-free force sensing ink for being deposited in a thin layer between a pair of conductors, each conductor being disposed on a support surface, said force sensing ink having a resistance which varies as a function of the force applied thereagainst, said force sensing ink being usable in force sensing applications at temperatures of from 150° F. to 350° F. and comprising a high temperature binder; intrinsically semi-conductive particles; and conductive particles comprising a conductive metal oxide compound based on an oxygen value of two.

2. A carbon free, force sensing ink in accordance with claim 1, and where said conductive particles comprise one of conductive tin oxide particles, $Fe_3O_4$ iron oxide particles and mixtures thereof.

3. A carbon-free, force sensing ink in accordance with claim 1, and further comprising dielectric particles.

4. A carbon-free, force sensing ink in accordance with claim 3, and wherein said dielectric particles are silica having an average particle size of 10 microns or less.

5. A carbon-free, force sensing ink in accordance with claim 1, and wherein said semi-conductive particles are molybdenum disulfide particles.

6. A carbon-free, force sensing ink in accordance with claim 1, and wherein all of said particles are of an average particle size of 10 microns or less.

7. A carbon-free, force sensing ink in accordance with claim 1, and wherein said high temperature binder is a thermoplastic polyimide resin.

8. A carbon-free, force sensing ink in accordance with claim 1, and wherein said conductive and semi-conductive particles are present in a combined concentration of at least 20% by volume of the dried ink when deposited in a thin layer.

9. A carbon free, force sensing ink in accordance with claim 8, and wherein the binder is present in a combined amount of from 20 to 80% by volume and said conductive and semi-conductive particles are present in a combined amount of from 80 to 20% by volume when deposited in a thin layer.

* * * * *

UNITED STATES PATENT AND TRADEMARK OFFICE

CERTIFICATE OF CORRECTION

PATENT NO. : 5,541,570
DATED : July 30, 1996
INVENTOR(S) : Donald J. McDowell

It is certified that error appears in the above-indentified patent and that said Letters Patent is hereby corrected as shown below:

Column 9, Line 10, add "in which the valence of the metal is not a whole integer" after the word --compound--.

Signed and Sealed this

Fifth Day of November, 1996

Bruce Lehman

*Attest:*

BRUCE LEHMAN

*Attesting Officer*

*Commissioner of Patents and Trademarks*